US008041279B2

(12) United States Patent
Kladias et al.

(10) Patent No.: US 8,041,279 B2
(45) Date of Patent: Oct. 18, 2011

(54) ISO-THERMALIZING GRAPHITE PRINTER STRUCTURE AND METHOD FOR USING SAME

(75) Inventors: Nicholas P. Kladias, Flushing, NY (US); Gerald A. Domoto, Briarcliff Manor, NY (US); Santokh Badesha, Pittsford, NY (US); Louis Fratangelo, Webster, NY (US); Patrick Finn, Webster, NY (US); Robert Pawlik, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 436 days.

(21) Appl. No.: 12/273,134

(22) Filed: Nov. 18, 2008

(65) Prior Publication Data

US 2010/0124446 A1 May 20, 2010

(51) Int. Cl.
*G03G 15/20* (2006.01)

(52) U.S. Cl. ..... 399/334; 399/328; 399/329; 399/330; 399/331

(58) Field of Classification Search ..... 399/328, 399/329, 330, 331, 334
See application file for complete search history.

(56) References Cited

U.S. PATENT DOCUMENTS

| | | | | |
|---|---|---|---|---|
| 6,367,509 | B1 * | 4/2002 | Bonneville et al. | 138/96 R |
| 7,072,609 | B2 * | 7/2006 | Karasawa | 399/327 |
| 7,228,098 | B2 | 6/2007 | Herley et al. | |
| 7,241,253 | B2 | 7/2007 | Oh et al. | |
| 7,261,146 | B2 * | 8/2007 | Oh | 165/135 |
| 7,349,660 | B2 | 3/2008 | Domoto et al. | |
| 7,418,228 | B2 | 8/2008 | Domoto et al. | |
| 2002/0039503 | A1 * | 4/2002 | Yamashita et al. | 399/307 |
| 2006/0291919 | A1 * | 12/2006 | Domoto et al. | 399/328 |
| 2007/0053168 | A1 * | 3/2007 | Sayir et al. | 361/718 |
| 2007/0125274 | A1 * | 6/2007 | Miller | 106/638 |
| 2008/0219718 | A1 * | 9/2008 | Fujita et al. | 399/307 |
| 2009/0084526 | A1 * | 4/2009 | Chang et al. | 165/104.26 |

* cited by examiner

*Primary Examiner* — David Gray
*Assistant Examiner* — G. M. Ali Hyder
(74) *Attorney, Agent, or Firm* — MH2 Technology Law Group LLP

(57) ABSTRACT

An iso-thermalizing printer structure can be used to provide temperature uniformity across a width of a printer fuser roll or fuser belt. Various embodiments are contemplated, including a solid natural graphite shaft, a solid natural graphite core having a sleeve of metal such as aluminum, and other flexible and rigid structures which can comprise natural or synthetic graphite.

19 Claims, 6 Drawing Sheets

ISO-THERMALIZING GRAPHITE PRINTER STRUCTURE AND METHOD FOR USING SAME

FIELD OF THE INVENTION

This invention relates to the field of printing devices, and more particularly to methods and structures which provide for the uniform heating of fuser rolls.

BACKGROUND OF THE INVENTION

Maintaining roll temperature uniformity in fuser roll systems has long been a concern of printer designers. The temperature along a width of the fuser roll can vary excessively, particularly in systems designed for print media of varying widths, which can adversely affect print quality. Printing long-edge feed paper after printing many copies of short-edge feed paper can also result in decreased printer performance. Using a heat pipe as a fuser roll is a known technique to solve such temperature uniformity issues. However, problems can arise in the complexity in the design of heat pipe fuser rolls, because heat pipes are closed systems and applying heat internally is difficult. Applying heat at one end of the fuser roll can be performed to simplify the geometry of the subsystem, but can result in incident heat flux at the heated end. In low mass, "instant-on" or rapid warm-up fuser roll systems, the low axial conductance of the fuser roll causes a greater thermal non-uniformity than in conventional fusing systems. It is generally preferable in instant-on systems to use a heat pipe with a low volume of fluid such as water or water-alcohol to more rapidly transfer heat from the warmer regions to the cooler regions of the fusing system rolls. Some heat pipe systems incorporate a fiber wicking device to sustain the fluid in the heat pipe. In this minimal fluid configuration, there is a potential for dry-out of the heat pipe evaporator. Systems to pump fluids using more complex interior geometries are also known and used to prevent the evaporator from drying out.

Low energy usage requirements in a fuser roll/pressure roll system can be met by minimizing the thermal mass of the fuser roll. Temperature uniformity can be met by heating element profile and design. Usually, these systems are optimized around the media size and weight most used in the market place. However, various media sizes and weights are used, which can contribute to temperature non-uniformity along the fuser roll axis. Another factor that contributes to temperature non-uniformity is conductive and convective heat losses from the heating lamps and the fuser roll, for example, to the bearings and supporting framework.

U.S. Pat. No. 7,349,660, commonly assigned to Xerox Corporation with the present application and incorporated herein by reference in its entirety, describes a heat pipe in contact with the fuser roll and/or the pressure roll to transfer heat from warmer regions to cooler regions so that a temperature along a length of the fuser roll and/or the pressure roll becomes more uniform.

SUMMARY OF THE EMBODIMENTS

One embodiment of a system for transferring an image to a print medium comprises at least at least one of a fuser roll/belt and a pressure roll/belt, and further comprises iso-thermalizing roll comprising a natural or synthetic graphite which has a thermal conductivity in the axial direction of at least 450 watts/meter-° C. The iso-thermalizing roll is in physical contact with the at least one of the fuser roll/belt and the pressure roll/belt.

Another embodiment of a system for transferring an image to a print medium comprises a fuser roll/belt, a pressure roll belt, and a graphite iso-thermalizing structure adapted to transfer heat from warmer regions of the fuser roll/belt to cooler regions of the fuser roll/belt.

Another embodiment uses a method for printing an image onto a print medium, comprising providing a printer comprising a fuser roll/belt and a pressure roll/belt. Also provided is a graphite iso-thermalizing structure. During printing, heat is transferred from warmer regions of the fuser roll/belt to cooler regions of the fuser roll/belt using the graphite iso-thermalizing structure.

BRIEF DESCRIPTION OF THE DRAWINGS

The accompanying drawings, which are incorporated in and constitute a part of this specification, illustrate embodiments of the invention and together with the description, serve to explain the principles of the invention. In the figures.

DESCRIPTION OF THE EMBODIMENTS

Reference will now be made in detail to the present exemplary embodiments of the invention, examples of which are illustrated in the accompanying drawings. Wherever possible, the same reference numbers will be used throughout the drawings to refer to the same or like parts.

Toner fuses to paper most uniformly when an appropriate temperature is maintained uniformly across the surface of the fuser roll. In various embodiments of the present invention, heat is transferred from warmer regions to cooler regions of the fuser roll using an iso-thermalizing structure. The iso-thermalizing structure preferably comprises graphite and transfers heat across the fuser roll. In various embodiments, the iso-thermalizing structure can contact the fuser roll directly, or it can contact various other structures to result in the surface of the fuser roll having a uniform temperature across its surface.

In other embodiments, a similar structure is used which contacts the pressure roll of a system comprising a belt fuser. The structure transfers heat from warmer regions to cooler regions of the pressure roll, which in turn contacts the belt fuser and results in a more even temperature across the surface of the belt fuser.

Figure 1:
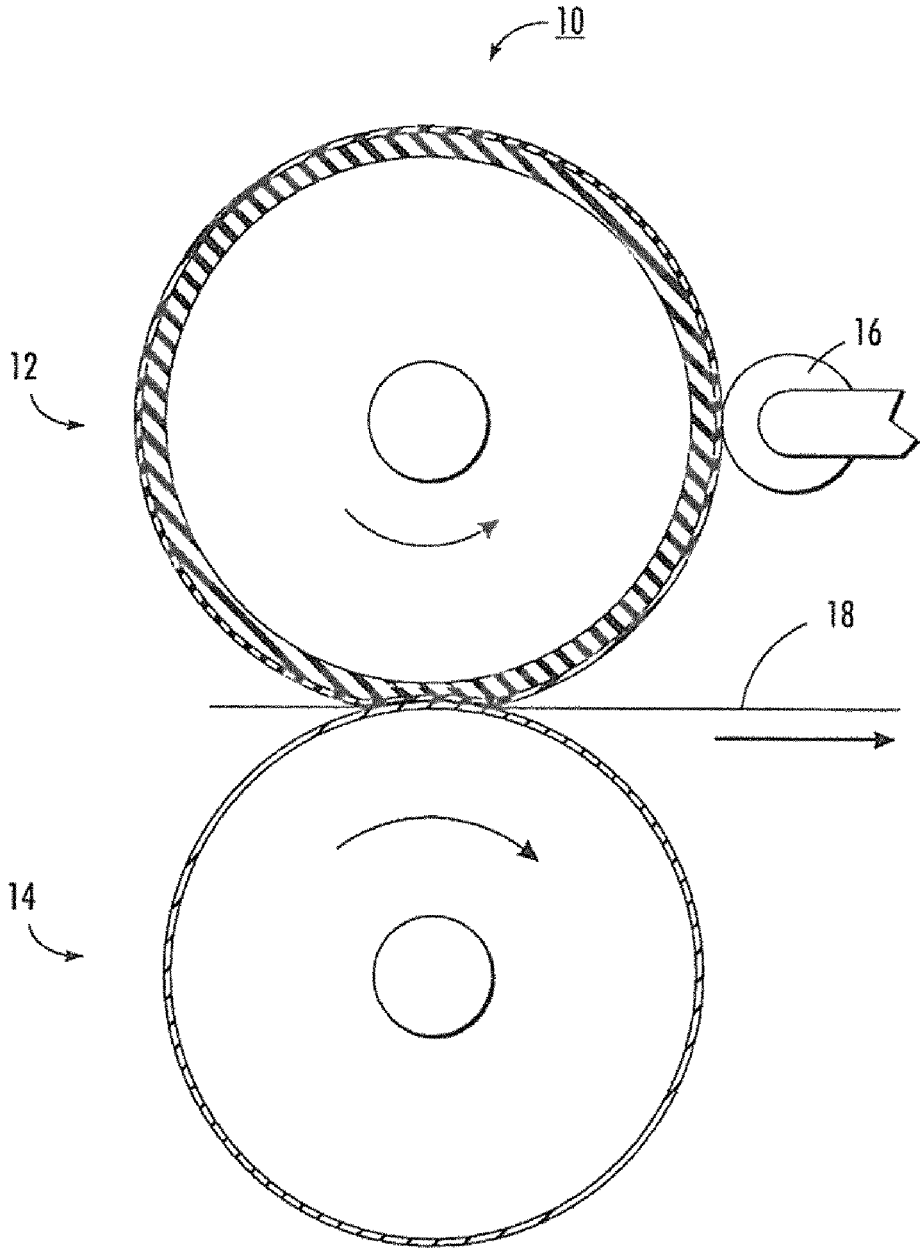
FIGS. 1-3 are cross sectional depictions of three different embodiments of printer portions, each comprising an iso-thermalizing roll in accordance with first, second, and third embodiments of the invention, respectively.

FIG. 1 is a schematic cross section depicting a first inventive embodiment comprising a portion 10 of a printer system. Portion 10 comprises a fuser roll 12, a compliant pressure roll 14, and an iso-thermalizing roll 16. In use, the iso-thermalizing roll 16 engages the fuser roll 12 during printing to transfer heat from warmer regions to cooler regions of the fuser roll 12.

In conventional systems used to print paper of various widths, the fuser roll can have a higher temperature at either end and a lower temperature in the middle. This can occur, for example, when printing on paper having a width which is less than the maximum printable width. Further, printing long-edge feed paper after printing many copies of short-edge feed paper can result in decreased printer performance. In use of the FIG. 1 embodiment, the iso-thermalizing roll 16 engages the fuser roll 12 to transfer heat from the warmer regions to cooler regions of the fuser roll. The iso-thermalizing roll is preferably manufactured from a material having a high thermal conductivity in the axial direction to provide even heating across the surface of the fuser roll 12. Thus the iso-thermalizing roll 16 receives excess heat, for example from ends of the fuser roll 12, which conducts axially along a length of the iso-thermalizing roll, and is transferred to cooler regions of the fuser roll 12.

In various embodiments, the iso-thermalizing roll 16 can be a solid shaft of natural or synthetic graphite. Natural graphite shafts can comprise crystalline flake graphite (i.e. "flake graphite"), amorphous graphite (i.e. "meta-anthracite"), or lump (vein) graphite. Synthetic graphite shafts can be manufactured from petroleum products and require thermal processes to convert carbon to graphite, and can comprise graphite fiber, graphite tubes, graphite reinforced composites (particularly graphene-reinforced composites), nanotubes, etc. These natural and synthetic materials have a high thermal conductivity in the axial direction. For purposes of the present invention, a material which has a "high thermal conductivity" in the axial direction is any material which has an in-plane thermal conductivity of at least 150 watts/meter-° C. (W/m-° C.). The axial thermal conductivity of natural graphite is about 450 W/m-° C. The in-plane thermal conductivity for a natural graphite shaft is about 2.2 times larger than a solid aluminum shaft of similar dimensions, and is therefore more efficient in redistributing heat from a warmer region to a cooler region along the length of the fuser roll. In addition, when compared with an aluminum shaft, a graphite shaft can be manufactured with a larger cross sectional area, about 1.5 times larger, due to its 1.5 times lower heat capacity to result in a structure having the same thermal mass as the aluminum shaft. The thermal conductance of such a graphite shaft would therefore be 3.3 times larger than that of an equivalent aluminum roll having an equivalent thermal mass.

The solid natural graphite shaft allows the heat from the high temperature regions outside the paper path to flow to the lower temperature paper path region and will heat the back of the paper to assist fusing of paper and toner. Additionally, the high temperature regions outside the paper path will cool to provide a more uniform temperature profile across the surface of the fuser roll.

According to an exemplary embodiment, the iso-thermalizing roll 16 can have a diameter of between about 10 mm and about 24 mm, for example about 18 mm, and is in contact with the fuser roll 12 along the entire length of the fuser roll. In another embodiment, the iso-thermalizing roll 16 can be in contact with less than the entire length of the fuser roll, but will generally be in contact with more than half the length of the fuser roll. In one embodiment, the graphite shaft can have a width equal to the widest printable medium. In another embodiment, the graphite shaft can have a width equal to the width of the exposed fuser roll. A contact height (as depicted in FIG. 1) between the iso-thermalizing roll 16 and the fuser roll 12 can be between about 0.001 mm and about 4.0 mm. A larger contact area will improve temperature uniformity of the fuser roll 12.

A solid, natural graphite shaft having a length of 33 cm and a diameter of 18 mm can be manufactured according to techniques known in the art. Natural graphite manufacturing is well known, for example for making die-formed packing rings and various kinds of gaskets. Natural graphite products are available commercially, for example from Sanguine Technologies, Inc of Irvine, Calif. or from Qingdao Duratight Sealing Product Co., Ltd. of Shandong Province, China.

Figure 2:
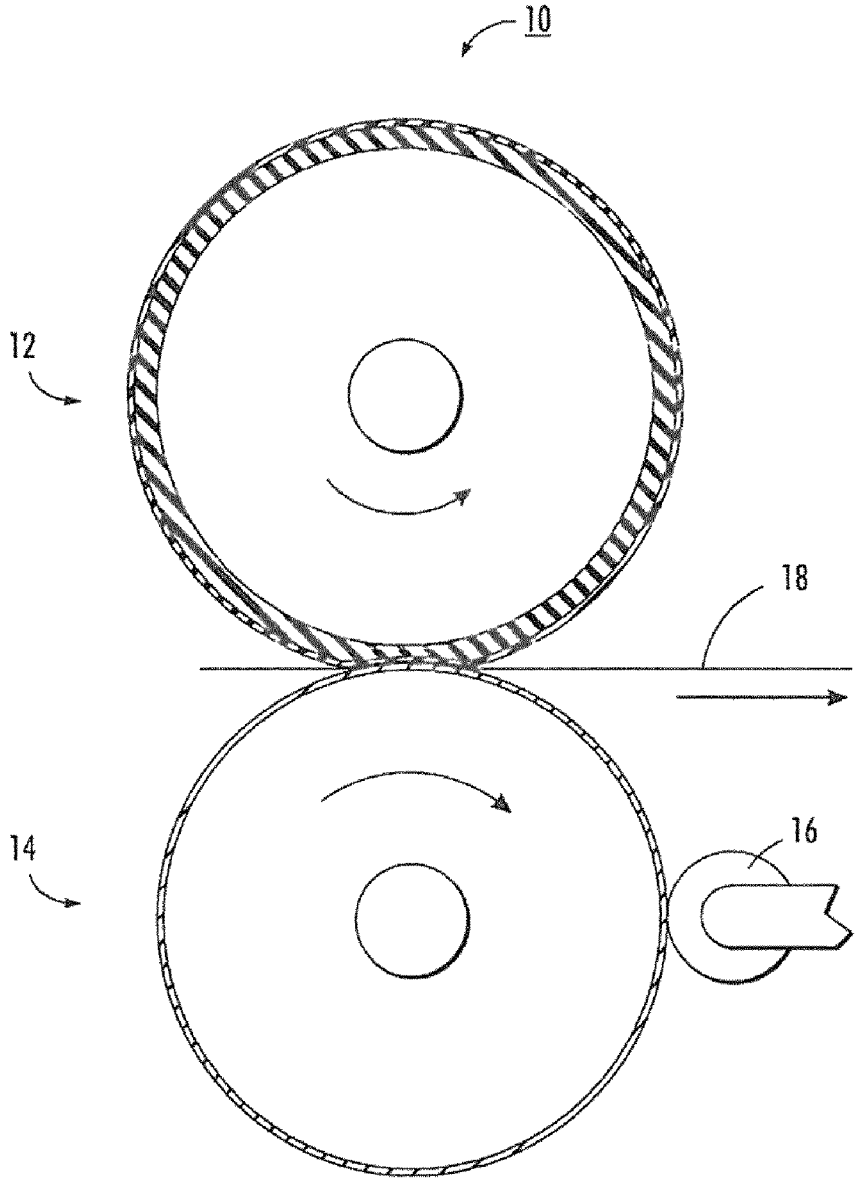

FIG. 2 depicts an embodiment in which the iso-thermalizinq roll 16 contacts the pressure roll 14. The iso-thermalizing roll 16 will even the temperature across the surface of the pressure roll. Then, through direct contact with the fuser roll 12, or through indirect contact with the fuser roll 12 through the print medium 18, the pressure roll 14 is used to even out the temperature across the surface of the fuser roll 12. While the FIG. 2 embodiment will likely be less efficient than the FIG. 1 embodiment, it may increase uniformity of the fuser roll 12 without requiring a delay in printing start times after receiving a print command.

During warm up and use of the printer to print an image onto a print medium such as paper, the solid graphite shaft will rotate against the fuser roll and/or the pressure roll to transfer heat from warmer regions to cooler regions of the fuser roll. If the graphite shaft contacts the fuser roll, heat is transferred directly by the graphite shaft from warmer regions to cooler regions of the fuser roll. If the graphite shaft contacts the pressure roll, heat is transferred indirectly, by first evening out the temperature of the pressure roll, which evens out the temperature of the fuser roll. The iso-thermalizing roll 16 will indirectly assist in maintaining an even temperature of the fuser roll through contact with, and temperature control of, the pressure roll 14.

Figure 7:
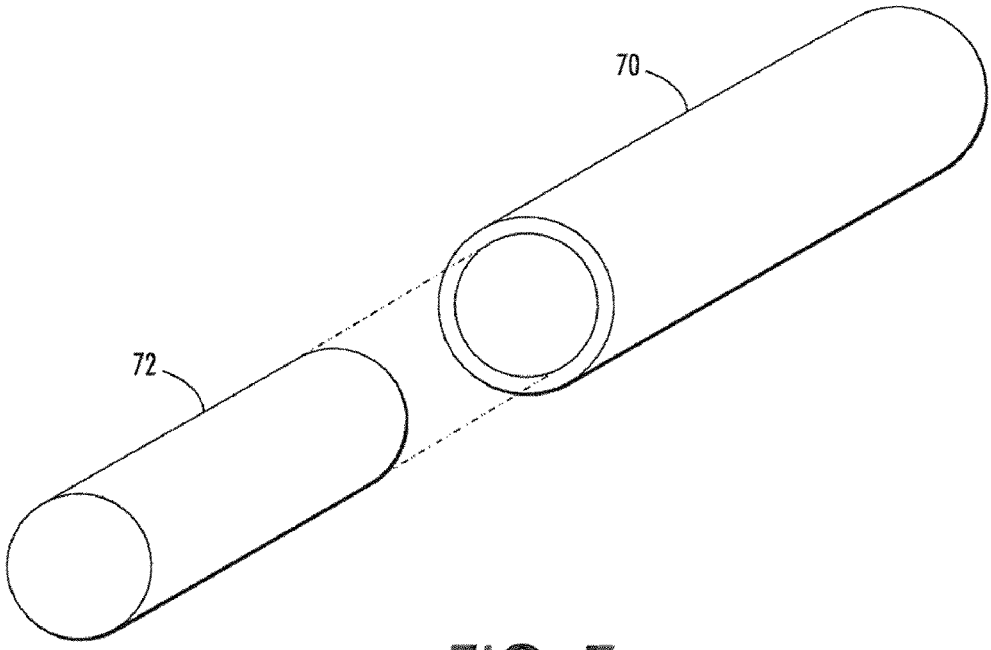
FIG. 7 is a perspective depiction of an embodiment including a metal sleeve which receives a solid core.

In other embodiments, an iso-thermalizing roll can comprise a hollow metal sleeve 70 such as that depicted in the perspective view of FIG. 7, for example manufactured from aluminum, which receives a solid natural graphite shaft 72 as a core of the iso-thermalizing roll. An iso-thermalizing roll having an outside diameter of 15 mm formed from a 12 mm solid graphite core 72 received within a 3 mm thick aluminum sleeve 70 would provide a roll having a thermal mass similar to a solid graphite shaft with an 18 mm diameter. An aluminum sleeve 70 having a thickness of 3 mm and a diameter of 15 mm can be machined, and a solid graphite core 72 can be manufactured using the techniques of the previous embodiment.

It is believed that both a solid natural graphite shaft and a graphite core having an aluminum sleeve would be less expensive than a heat pipe. Either would provide only slightly diminished functionality over a heat pipe. With current technology, it is estimated that a natural graphite shaft would cost only about 20% of the cost of a heat pipe, and would likely provide improved reliability as the use of a sealed fluid is avoided. A shaft comprising a natural graphite core and an aluminum sleeve as described above would have a similar cost and reliability improvement as the solid shaft.

Belt fuser systems are also configured to print media of various widths. When printing a narrow width medium, the edges of the belt can heat to a temperature greater than an optimum temperature. Similarly, a temperature toward a center of the belt can cool to a temperature below the optimum temperature as a result of heat transfer to the printed medium during fusing of the toner.

Figure 3:
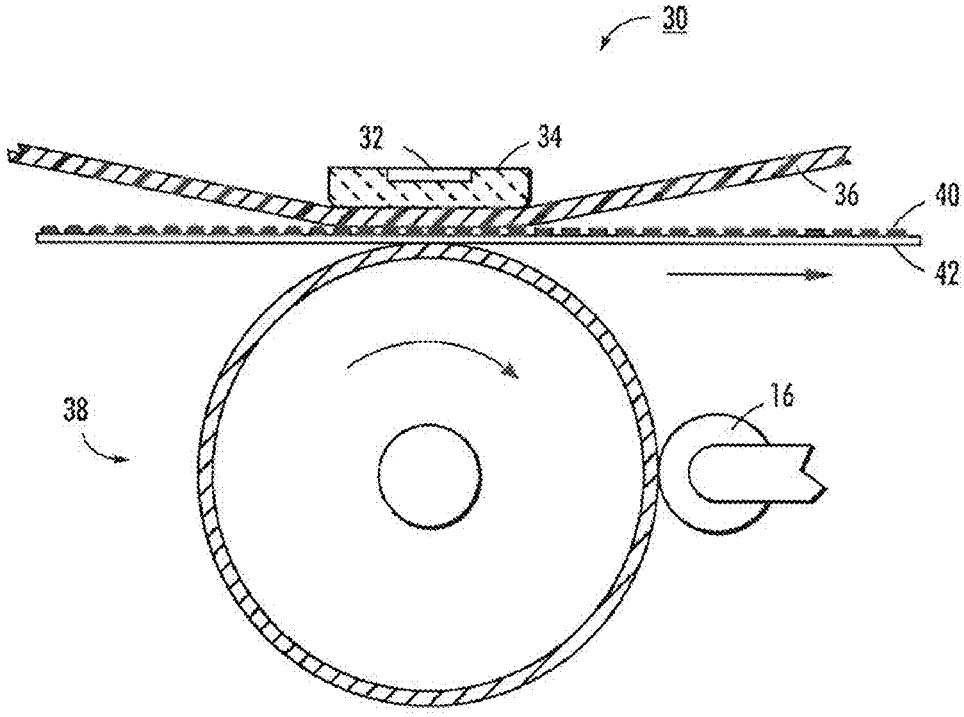

FIG. 3 depicts another embodiment of the invention comprising a portion 30 of a belt fuser printer system. FIG. 3 depicts a deposited heating layer 32 formed within a ceramic substrate 34, which contacts a belt 36 of a belt fuser, for example an instant-on belt fuser. The printing portion 30 further comprises a pressure roll 38 and an iso-thermalizing roll 16 which contacts the pressure roll 38. In use, the deposited heating layer 32 heats the ceramic substrate 34 which in turn heats the belt 36. Pressure between the belt 36 and the pressure roll 38, in combination with heat transferred from the deposited heating layer 32 through the ceramic substrate 34 and to the belt 36, fuses toner 40 to the print medium 42. During use, the iso-thermalizing roll 16, preferably a solid natural graphite shaft or aluminum-sleeved graphite shaft in accordance with previous embodiments, transfers heat from warmer regions of the pressure roll to cooler regions. In turn, the pressure roll transfers heat from warmer regions of the fuser roll to cooler regions, particularly across a width of the belt, to provide for improved printing of the belt fuser system.

Thus the system of FIG. 3 will exchange heat from high temperature regions outside the paper path to a lower temperature paper path region, which serves to improve heating of the back of the print medium and assists fusing of the toner to the print medium. Additionally, the high temperature regions outside the paper path will cool to achieve a more uniform temperature profile along the width of the belt, the heating device, and the pressure roll.

Contacting the iso-thermalizing roll with the belt would draw energy from the belt and would substantially increase warm-up time and energy requirements. The system as depicted in FIG. 3, with the iso-thermalizing roll in contact with the pressure roll, therefore decreases energy requirements and warm-up time.

Figure 4:
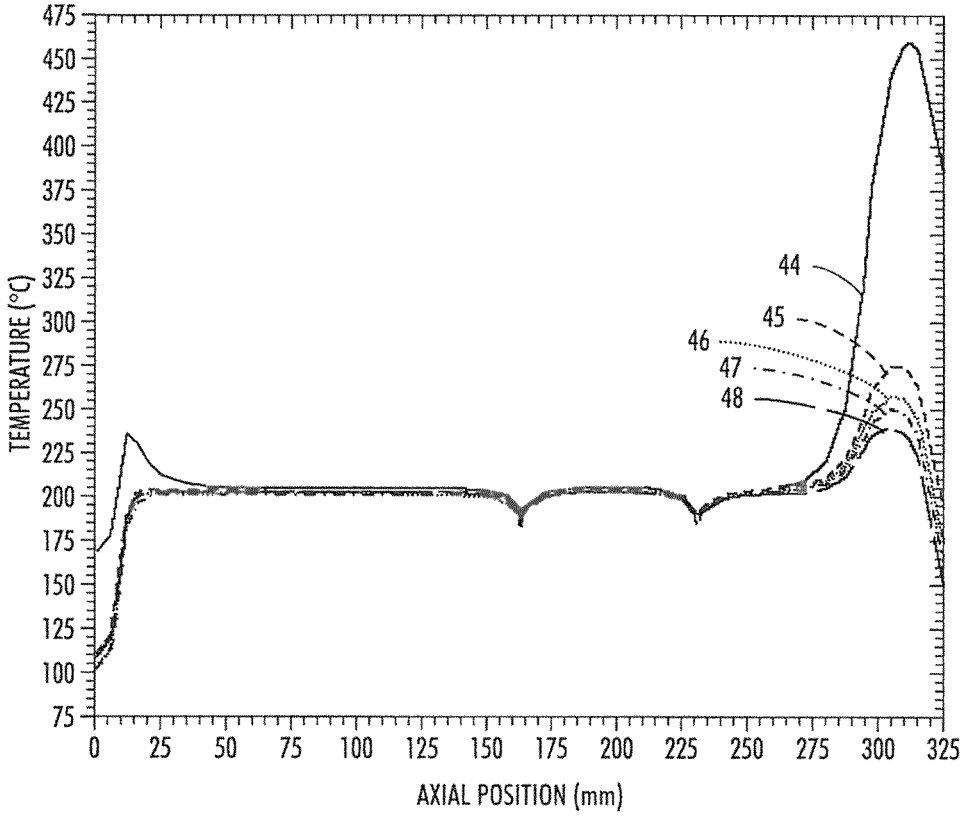
FIG. 4 is a graph depicting heat profiles comparing various inventive and conventional structures used in an attempt to even the temperature across a width of a printer fuser roll.

FIG. 4 depicts a graph produced by simulation of various materials in contact with the pressure roll used in an attempt to improve temperature uniformity across a width of a fuser belt. The axial position specified is relative to the outboard edge of the fuser roll. Further, the two decreases at 160 mm and 235 mm represent 1 mm gaps between adjacent, individually controlled heater segments which can be used in a conventional instant-on belt fuser system to provide improved heat uniformity across the width of the belt.

As depicted in the graph of FIG. 4, the baseline 44, which includes no iso-thermalizing roll, provides an acceptable level of uniformity in the center region of the belt, within the paper path. However, the temperature spikes at either edge outside the paper path, particularly at an axial position of 300 mm. Depicted iso-thermalizing rolls in the FIG. 4 graph include, in increasing order of efficiency: a solid aluminum shaft 45 having an outside diameter of 15 mm; a 12 mm solid graphite shaft 46 providing a graphite core with a 1.5 mm thick aluminum sleeve having an outside diameter of 15 mm; a solid natural graphite shaft 47 having an outside diameter of 18 mm, and; a liquid-filled heat pipe 48 having an outside diameter of 15 mm.

Of the iso-thermalizing rolls depicted in FIG. 4, the heat pipe 48 provides the best uniformity. However, the solid natural graphite shaft 47 contacting the pressure roll provides, in many cases, an acceptable temperature profile only slightly less uniform than a heat pipe, and with an improved reliability at an estimated cost of about ⅕ that of a heat pipe.

In addition to the solid graphite shaft, the iso-thermalizing roller comprising a 12 mm graphite core with a 1.5 mm thick aluminum sleeve, which forms an iso-thermalizing roll having an outside diameter of 15 mm, provides only slightly less heat uniformity than the solid graphite shaft with a 18 mm diameter, and at a similar cost as the solid natural graphite shaft.

Figure 5:
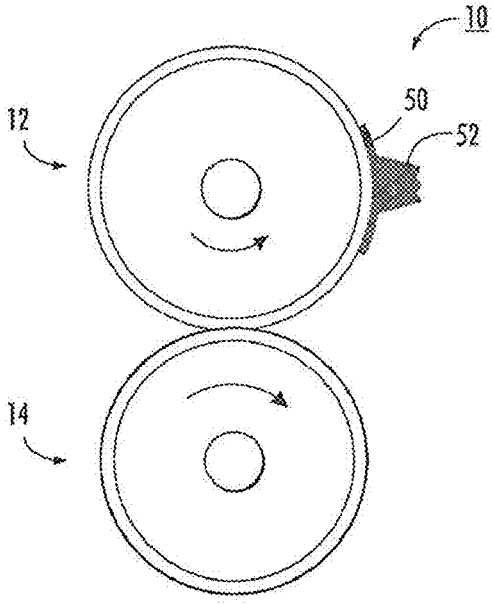
FIGS. 5 and 6 are cross sectional depictions of two different embodiments of printer portions, each comprising an iso-thermalizing structure in accordance with fourth and fifth embodiments of the invention, respectively.
Figure 6:
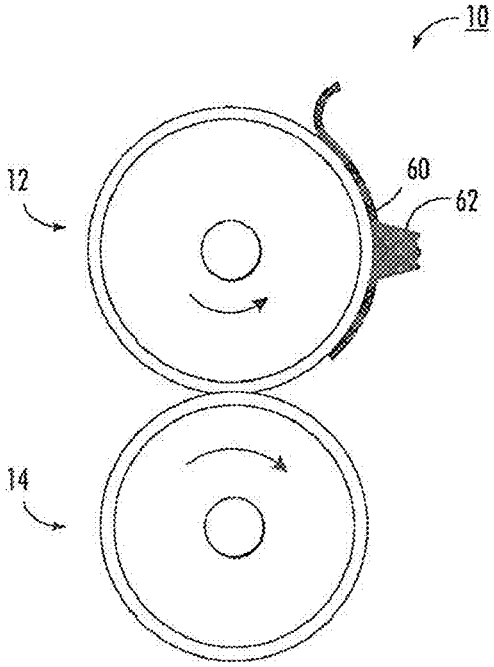

Various additional embodiments comprising graphite structures having other configurations are also contemplated. FIGS. 5 and 6, for example, each depict a portion of printer system 10 comprising a fuser roll 12 and a pressure roll 14 in accordance with previous embodiments. FIG. 5 further depicts a natural graphite "shoe" 50 which contacts the fuser roll 12 over the area depicted in FIG. 5, and a support structure represented by 52 which physically connects the shoe 50 to another printer structure. Similarly, FIG. 6 shows a natural graphite sling 60 such as a flexible graphite strip in contact with the fuser roll, and a support structure represented by 62 which physically connects the sling 60 to another printer structure. The larger the contact area, the more efficient the graphite "shoe" or sling will be in achieving a uniform profile.

Other indicative applications of the proposed embodiments include:

(a) heated members, for example paper preheat structures such as rolls, belts or plates;

(b) drums, for example heated drums in solid ink jet printers; and (c) release oil heating devices.

Various embodiments thus provide an iso-thermalizing structure which improves temperature uniformity across the surface of a fuser roll over systems which do not comprise an iso-thermalizing structure. In addition, various embodiments provide an iso-thermalizing structure which is less costly than a heat pipe. Additionally, various embodiments can be used with belt-based systems and roll-based systems, and as such the present application may recite a structure used with a fuser member such as either a fuser roll or a fuser belt (i.e., a "fuser roll/belt") or with a pressure member such as either a pressure roll or a pressure belt (i.e., a "pressure roll/belt").

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising". The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A system for transferring an image to a print medium, comprising:

one of a fuser member and a pressure member; and an iso-thermalizing roll comprising a solid shaft of graphite, wherein the iso-thermalizing roll is in physical contact with the one of the fuser member and the pressure member.

2. The system of claim 1 further comprising the other of the fuser member and the pressure member, wherein the iso-thermalizing roll is in physical contact with the pressure member and is not in physical contact with the fuser member.

3. The system of claim 1 further comprising the other of the fuser member and the pressure member, wherein the iso-thermalizing roll is in physical contact with the fuser member and is not in physical contact with the pressure member.

4. The system of claim 1, wherein the iso-thermalizing roll further comprises a hollow aluminum sleeve which receives the solid graphite shaft, wherein the hollow aluminum sleeve contacts the at least one of the fuser member and the pressure member.

5. The system of claim 1 wherein the one of the fuser member and the pressure member is a pressure roll and the system further comprises a belt fuser, wherein the iso-thermalizing roll is in physical contact with the pressure roll.

6. A system for transferring an image to a print medium, comprising:

a fuser member;

a pressure member; and a solid graphite iso-thermalizing structure adapted to transfer heat from warmer regions of the fuser member to cooler regions of the fuser member.

7. The system of claim 6 wherein the fuser member is a fuser roll and the solid graphite iso-thermalizing structure is an arc-shaped graphite sheet having a contour which matches a contour of the fuser roll and is in contact with the fuser roll.

8. The system of claim 6 wherein the solid graphite iso-thermalizing structure is a flexible graphite strip.

9. The system of claim 6 wherein the solid graphite iso-thermalizing structure comprises a solid graphite shaft.

10. The system of claim 9 wherein the solid graphite shaft has a diameter of between about 15 mm and about 18 mm, and the solid graphite shaft contacts at least one of the fuser member and the pressure member.

11. The system of claim 9 wherein the solid graphite iso-thermalizing structure further comprises a hollow metal sleeve which receives the solid graphite shaft, and the hollow metal sleeve contacts at least one of the fuser member and the pressure member.

12. A method for printing an image onto a print medium, comprising:

providing a printer comprising a fuser member and a pressure member;

providing a solid graphite iso-thermalizing structure;

during printing, transferring heat from warmer regions of the fuser member to cooler regions of the fuser member using the solid graphite iso-thermalizing structure.

13. The method of claim 12, further comprising:

providing the solid graphite iso-thermalizing structure comprising a solid graphite shaft; and during printing, rotating the fuser member, the pressure member, and the solid graphite shaft, such that the iso-thermalizing structure physically contacts at least one of the fuser member and the pressure member.

14. The method of claim 13, further comprising:

providing a hollow metal sleeve which receives the solid graphite shaft; and during printing, rotating the fuser member, the pressure member, the solid graphite shaft, and the metal sleeve, such that the metal sleeve physically contacts at least one of the fuser member and the pressure member.

15. A system for transferring an image to a print medium, comprising:

a fuser member;

a pressure member; and a graphite iso-thermalizing structure comprising a solid graphite shaft adapted to transfer heat from warmer regions of the fuser member to cooler regions of the fuser member, wherein the solid graphite shaft has a diameter of between about 15 mm and about 18 mm, and the solid graphite shaft contacts at least one of the fuser member and the pressure member.

16. The system of claim 15, wherein the graphite iso-thermalizing structure has a thermal conductivity in the axial direction of at least 450 watts/meter-° C.

17. The system of claim 15, wherein the graphite iso-thermalizing structure has a thermal conductivity in the axial direction of at least 150 watts/meter-° C.

18. The system of claim 15, wherein the solid graphite shaft contacts the fuser member and does not contact the pressure member.

19. The system of claim 15, wherein the solid graphite shaft contacts the pressure member and does not contact the fuser member.

* * * * *